US010273696B2

(12) United States Patent
Scherrer

(10) Patent No.: US 10,273,696 B2
(45) Date of Patent: Apr. 30, 2019

(54) DEVICE FOR RE-CLADDING A REMOVEABLE FALSE-WALL PANEL

(71) Applicant: Jean-Marc Scherrer, Riedisheim (FR)

(72) Inventor: Jean-Marc Scherrer, Riedisheim (FR)

( * ) Notice: Subject to any disclaimer, the term of this patent is extended or adjusted under 35 U.S.C. 154(b) by 0 days.

(21) Appl. No.: 14/350,612

(22) PCT Filed: Oct. 11, 2012

(86) PCT No.: PCT/FR2012/052313

§ 371 (c)(1),
(2) Date: Apr. 9, 2014

(87) PCT Pub. No.: WO2013/054048

PCT Pub. Date: Apr. 18, 2013

(65) Prior Publication Data

US 2015/0267416 A1 Sep. 24, 2015

(30) Foreign Application Priority Data

Oct. 11, 2011 (FR) ..... 11 03097

(51) Int. Cl.

| | |
|---|---|
| ***E04B 9/30*** | (2006.01) |
| ***E04F 13/078*** | (2006.01) |
| ***E04F 13/00*** | (2006.01) |
| ***E04F 13/08*** | (2006.01) |
| *E04B 9/04* | (2006.01) |

(52) U.S. Cl.

CPC ..... *E04F 13/078* (2013.01); *E04B 9/303* (2013.01); *E04F 13/005* (2013.01); *E04F 13/0866* (2013.01); *E04B 2009/0492* (2013.01)

(58) Field of Classification Search

None

See application file for complete search history.

(56) References Cited

U.S. PATENT DOCUMENTS 1,997,605 A * 4/1935 Strom ..... E04B 9/26 52/145
2,728,390 A * 12/1955 Turner, Jr. ..... E06B 9/521 160/327
2,755,484 A * 7/1956 Hotz ..... E04H 4/142 160/330
3,514,914 A * 6/1970 Bergquist ..... A47G 27/0456 52/273

(Continued)

FOREIGN PATENT DOCUMENTS

DE 2609873 A1 9/1977
DE 102007033613 A1 1/2009

(Continued)

*Primary Examiner* — Kyle J. Walraed-Sullivan

(74) *Attorney, Agent, or Firm* — Bachman & LaPointe, P.C.

(57) ABSTRACT

The invention relates to a device for re-cladding a removable panel comprising an outer face, an inner face situated on the opposite side to the outer face, and a peripheral edge joining the outer and inner faces, said re-cladding device is notable in that it comprises at least two cladding sections the vertical cross section of which is in the overall shape of a C and which are fixed facing one another along two respective opposing regions of said peripheral edge, and a fabric is kept stretched along the outer face of the removable panel by said cladding sections.

15 Claims, 3 Drawing Sheets

(56) References Cited

U.S. PATENT DOCUMENTS 3,783,931 A * 1/1974 Assael ..... A47H 1/18 160/327
3,857,216 A * 12/1974 Sherman ..... E04B 9/26 52/506.06
3,866,016 A * 2/1975 Tombu ..... B05C 7/02 219/213
3,928,897 A * 12/1975 Tombu ..... B44C 7/022 160/327
4,018,260 A * 4/1977 Baslow ..... B25B 27/0092 160/327
4,053,008 A * 10/1977 Baslow ..... B44C 7/022 160/327
4,197,686 A * 4/1980 Baslow ..... E04B 9/306 160/327
4,213,493 A * 7/1980 Haworth ..... B44C 7/022 160/351
4,391,073 A 7/1983 Mollenkopf et al.
4,546,584 A * 10/1985 Mieyal ..... E04B 2/7457 52/222
4,566,236 A * 1/1986 Pound ..... A01G 9/1415 52/222
4,788,806 A * 12/1988 Sease ..... B44C 7/022 160/395
4,901,485 A * 2/1990 Menchetti ..... E04B 9/0428 181/291
4,947,561 A * 8/1990 Delacroix ..... B44D 3/185 160/392
4,986,332 A * 1/1991 Lanuza ..... B44C 7/022 160/327
5,029,422 A * 7/1991 Scherrer ..... B44C 7/022 160/392
5,214,891 A * 6/1993 Edlin ..... E06B 9/521 160/327
5,226,274 A * 7/1993 Sommerstein ..... E04F 13/0805 52/509
5,444,953 A * 8/1995 Koenig ..... E04F 13/18 52/255
5,715,638 A * 2/1998 Anderson, Sr. ..... E04F 13/0835 52/144
5,970,669 A * 10/1999 Livingston ..... E04B 1/8409 160/327
6,170,214 B1 * 1/2001 Treister ..... E04F 13/0808 52/235
6,431,251 B1 * 8/2002 Yerusalim ..... A47H 23/00 160/327
6,499,262 B1 * 12/2002 Pinchot ..... E04B 9/001 160/327
2003/0136073 A1 * 7/2003 Arx ..... E04B 9/303 52/511
2005/0139334 A1 * 6/2005 Bernardi ..... E04B 9/303 160/378
2006/0231221 A1 * 10/2006 Chen ..... E06B 9/24 160/392
2008/0010927 A1 * 1/2008 Wilson ..... E04F 13/0803 52/387
2008/0120936 A1 * 5/2008 Hull ..... E04B 1/7675 52/483.1
2008/0235923 A1 * 10/2008 Trageser ..... B43M 15/00 24/711.3
2009/0139167 A1 * 6/2009 Donaldson ..... B62D 33/046 52/272
2010/0024333 A1 * 2/2010 Scherrer ..... E04B 9/303 52/273
2011/0061320 A1 * 3/2011 Scherrer ..... E04F 13/005 52/222
2011/0280041 A1 * 11/2011 Perez ..... D03D 15/00 362/581
2015/0262519 A1 * 9/2015 Suciu ..... G09F 15/0025 40/777

FOREIGN PATENT DOCUMENTS

EP 0338925 A1 10/1989
FR 2727711 A1 6/1996

* cited by examiner

DEVICE FOR RE-CLADDING A REMOVEABLE FALSE-WALL PANEL

BACKGROUND

The present invention relates to a device for stretching a flexible fabric to be used for covering a removable panel of a false wall such as, for example, a ceiling and a false wall. The present invention also relates to a method for covering such a panel using said device.

False walls have long been known, which are arranged parallel to one wall of the room so as to leave a residual space between the wall of said room and said fabric. This residual space, also called a velum, makes it possible to accommodate all unsightly equipment such as electrical cables, pipes, etc. These false walls, more particularly false suspended ceilings, comprise either removable panels suspended from a grid of sections advantageously made of light-alloy, or a generally opaque, flexible sheet, deformed by stretching so that the edges thereof, provided with fastening means, can be fixed to fastening wall rails fixed to the walls of the room, for example.

Removable panels degrade over time and in particular lose their original aesthetic appearance. To remedy this problem, the degraded panel(s) can be changed and the cuts and holes existing in the original panel(s) can be repeated, if necessary. This method is time-consuming especially when it is necessary to repeat the cut-outs and holes, if any, in the new panel, but also expensive because a new panel has to be bought. In addition, the degraded original panel(s) are thrown away or partially recycled, which goes against the current trend which tends to limit the volume of waste for obvious environmental reasons.

SUMMARY

The present invention aims at overcoming the various disadvantages described above by providing a device for re-cladding enabling to re-clad in a simple, fast and especially aesthetical way removable panels of a false wall which are at least partially degraded.

In this respect, a device is provided for re-cladding a removable panel comprising an outer surface, an inner surface situated on the opposite side of the outer surface and a peripheral edge joining the outer and inner faces.

The re-cladding device according to the invention is characterized in that it comprises at least two cladding sections which are fixed facing one another along two respective opposing regions of said peripheral edge, and a stretchable fabric is kept stretched along the outer face of the removable panel by means of said cladding sections.

Preferably, the cladding sections form a closed frame fixed along the entirety of said peripheral edge.

Advantageously, each cladding section is fixed to the removable panel by any suitable technique such as force fitting, gluing, nailing or even screwing.

Each cladding section advantageously comprises a core and two flanges extending substantially perpendicularly from the ends of said core.

According to a first embodiment, the fabric is in contact with the outer face of the removable panel and the peripheral edge is held clamped between said cladding sections and said removable panel.

In a second alternative embodiment, each cladding section is so fixed to the removable panel that the core and the flanges are respectively in contact with the peripheral edge and the outer and inner faces of the removable panel.

Preferably, the fabric is not in contact with the outer face of the removable panel and is fixed and stretched on the cladding sections while being supported at least on the flanges thereof in contact with the outer face of the removable panel. Advantageously, the fabric is fixed to the cladding sections by any suitable means such as glue, nails or screws.

In another preferred embodiment, each cladding section comprises at least one housing able to cooperate with a fixing clamp, with the fabric being then fixed to said cladding section while being held clamped in said housing by the fixing clamp.

In another alternative embodiment, each cladding section is a clamping section fixed to the removable panel.

According to yet another preferred embodiment, each section is associated with a clamping section fixed by any suitable means, on the flange in contact with the outer face of the removable panel.

Preferably, the clamping section comprises at least one longitudinal inner recess in the overall shape of a U extending preferably substantially parallel to the core of said cladding section, with an aperture opening on one side to the outside, and on the other side in said recess and at least one flexible lip at least partially closing said aperture.

In a fourth alternative embodiment, the clamping section comprises at least one outer flange preferably extending substantially parallel to the core of said cladding section, with an inner core originating from one of the ends of the outer flange and extending substantially perpendicularly from said outer flange, and an inner flange originating from the inner core, extending toward the outside of said cladding section parallel to the outer flange and the free end of which forms a narrow peripheral support, with the outer flange having a shoulder extending perpendicularly from the free end thereof towards the inner flange, the outer flange, a portion of the inner core, the inner flange and the shoulder defining an open recess.

Advantageously, the fabric is provided with fastening means fixed at the periphery thereof and being of the harpoon type having the shape of a hook.

According to a final preferred embodiment, the cladding section 6 and the associated clamping section 20, 30 are solid.

BRIEF DESCRIPTION OF THE DRAWINGS

Other advantages and characteristics will become more apparent from the following description of several alternative embodiments, given as non-limiting examples, of a device for stretching a flexible fabric and installing a controlled mechanical ventilation of the type according to the invention, while referring to the appended drawings wherein.

DETAILED DESCRIPTION

Figure 1:
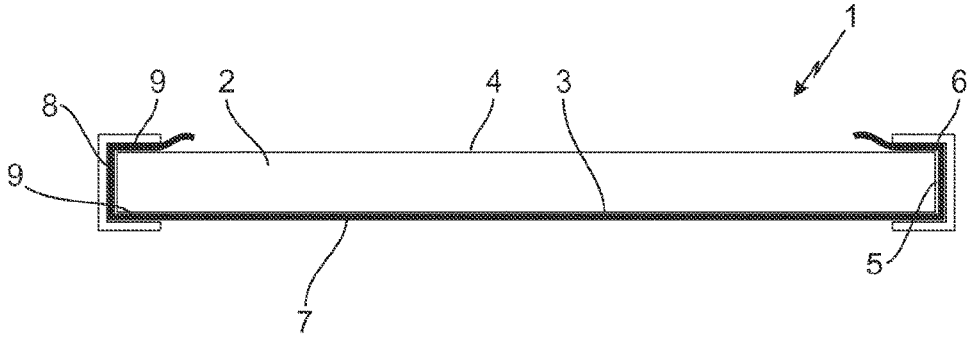
FIG. 1 is a vertical section of a removable panel with a first embodiment of the re-cladding device according to the invention.

FIGS. 1, 2, 5 and 6 show a re-cladding device 1, according to the invention, of a removable panel in a false wall 2 of a room such as, for example, a false ceiling or a false wall. Said removable panel 2 comprises an outer face 3 visible from the room, an inner surface 4 situated on the opposite side of the outer surface 3 and a peripheral edge 5 joining the inner 3 and outer faces 4. Said re-cladding device 1 comprises at least two cladding sections 6, the cross section of which is in the overall shape of a C and fixed facing one another along two respective opposing regions of the peripheral edge 5 of said removable panel 2, and a fabric 7 is kept stretched along the outer face 3 of the removable panel 2 by at least two cladding sections 6. Preferably, the cladding sections 6 form a closed frame fixed along the entirety of said peripheral edge 5.

FIG. 1 shows a first embodiment of the re-cladding device 1, wherein the fabric 7 is in contact with the outer face 3 of the removable panel 2 and the peripheral edge thereof is held clamped between two cladding sections 6 and said removable panel 2. This configuration makes it possible to keep the fabric in a stretched position. To obtain this first embodiment, a fabric 7 is cut to dimensions larger than those of said outer face 3, and then the fabric 7 is stretched on the removable panel 2 by being placed in contact with said outer face 3 and by folding the showing fabric 7 at least on the peripheral edge 5 of said removable panel 2; finally at least two cladding sections 6 are fixed facing one another along two respective opposing regions of said peripheral edge 5 of said removable panel 2 to hold clamped the edge of the fabric 7 between at least two cladding sections 6 and said peripheral edge 5.

Figure 3:
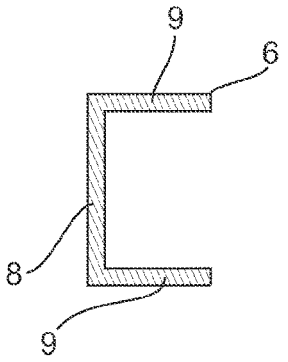
FIG. 3 is a vertical section of a first embodiment of the cladding section of the re-cladding device of FIG. 1 or 2.

Referring to FIG. 3, each cladding section 6 comprises a core 8 and two flanges 9 extending substantially perpendicularly from the ends of said core 8. Each cladding section 6 is fixed to the removable panel 2 by any appropriate means and/or techniques known to those skilled in the art. Thus, each cladding section 6 can be force-fitted, glued, nailed or screwed onto the removable panel 2.

The flexible fabric 7 is advantageously stretchable and made from a sheet of a polymer material such as polyvinyl chloride, with said material having numerous qualities such as fire resistance, air- as well as dust- or moisture-tightness, maintainability, etc.

However, the first alternative embodiment of the re-cladding device 1 shown in FIG. 1 is not entirely satisfactory because the fabric 7 is stretched in contact with the outer face 3 of the removable panel 2 and therefore, if the removable panel 2 is uneven, the bumps and pits may still be visible after the positioning of said fabric 7, thus possibly creating an unsightly appearance.

Figure 2:
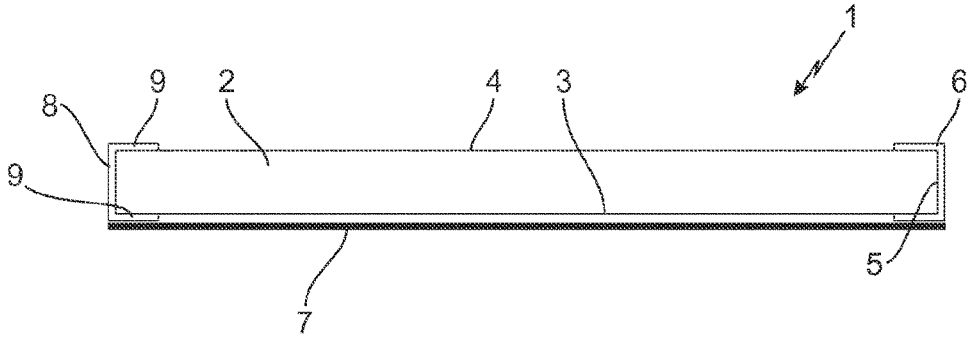
FIG. 2 is a vertical section of a removable panel with a second alternative embodiment of the re-cladding device according to the invention.

To remedy this drawback, FIG. 2 shows a second alternative embodiment of the re-cladding device 1, wherein the fabric 7 is no longer in contact with the outer face 3 of the removable panel 2. For this purpose, the fabric 7 is fixed and stretched over cladding sections 6, similar to those shown in FIG. 3, while being supported at least on the flanges 9 thereof in contact with the outer face 3 of the removable panel 2. In this second embodiment, when the cladding sections 6 are fixed to the removable panel 2, the core 8 thereof is in contact with the peripheral edge 5 and the flanges 9 thereof are in contact respectively with the inner 3 and outer faces 4. In this configuration, it should be understood that, as the fabric 7 is not in contact with said outer face 3, the bumps and pits of the outer face 3 of the removable panel 2 will no longer be apparent after the positioning of the fabric 7. This disadvantage is avoided by positioning a cladding section 6 on the removable panel 2 and by fixing the fabric 7 on said cladding section 6. The fabric 7 is fixed to the cladding sections 6 by any means known to those skilled in the art such as, for example, glue, nails, screws or using clips.

Figure 4:
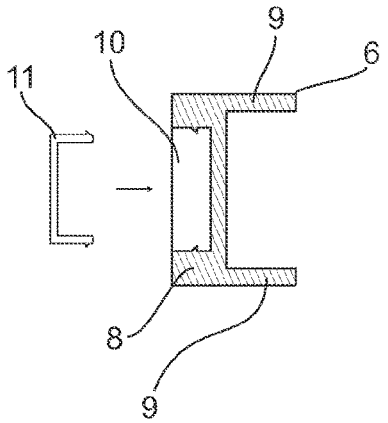
FIG. 4 is a vertical section of a second embodiment of the cladding section of the re-cladding device of FIG. 2.

With respect to the latter means for fixing the fabric and with reference to FIG. 4, which shows a second embodiment of the cladding sections 6, each cladding section 6 may comprise at least a housing 10 able to cooperate with a fixing clamp 11. The fabric 7 is then fixed to said cladding section 6 while being held clamped in said housing 10 by the fixing clamp 11. The housing 10 may be situated in the core 8 and/or the flange 9 in contact with the inner surface 4 of the removable panel 2.

The fabric 7 may be manually pulled and stretched before being fixed 7.

Besides, in order to improve the aspect of the stretched fabric 7, the latter may be preheated and then stretched and finally fixed to each cladding section 6 of the removable panel 2. As a matter of fact, it should then be understood that, when the fabric 7 cools, it shrinks, which results in increasing the stretching of the fabric 7, thus guaranteeing a flawless appearance.

Thus, it should be understood that the removable panel 2 covered with a fabric 7 regains its aesthetic appearance while retaining its original properties such as fire resistance, or sound insulation, for example. In addition, since the fabric 7 is preferably made from a sheet of polymeric material such as polyvinyl chloride, the covered removable panel 2 therefore has new properties such as: maintainability, air-, dust- or moisture-tightness, and becomes easily washable.

Furthermore, it should be understood that this invention is interesting because it makes it possible to re-clad degraded removable panels 2 without having to repeat the holes and cuts which may have been made in said removable panels 2.

Figure 5:
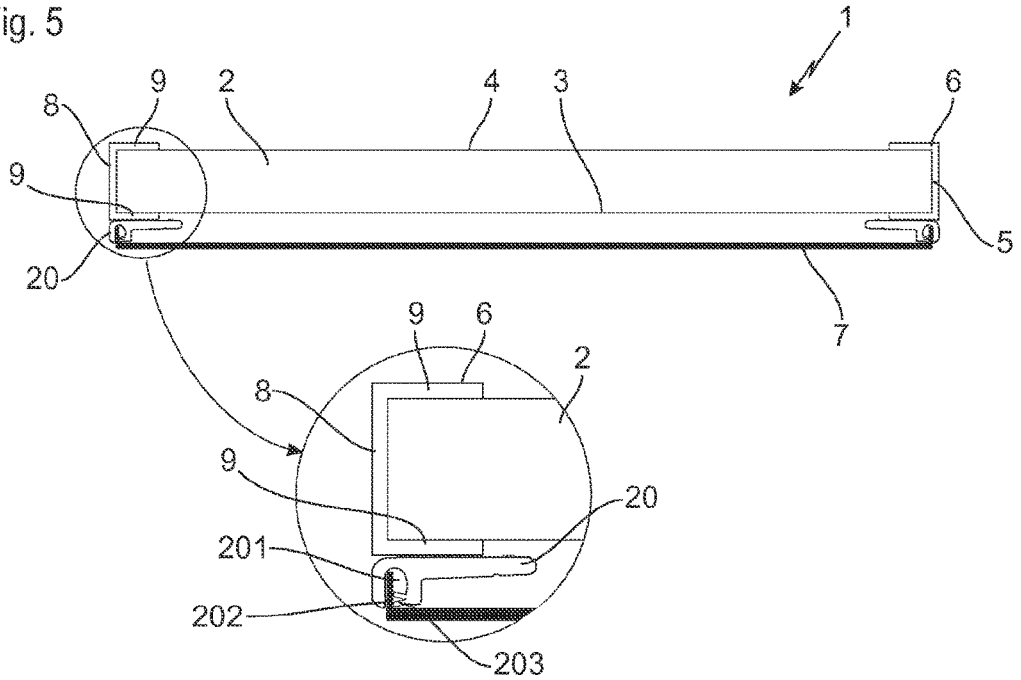
FIG. 5 is a vertical section of a removable panel with a third alternative embodiment of the re-cladding device according to the invention.

In a third alternative embodiment shown in FIG. 5, each cladding section 6 is similar to that shown in FIG. 3 and is associated with a fixing clamp 20 fixed by any suitable means, on the flange 9 in contact with the outer face 3 of the removable panel 2. The clamping section 20 comprises at least one inner longitudinal recess 201 having the general shape of a U extending preferably substantially parallel to the core 8 of said cladding section 6, an aperture 202 opening on one side to the outside and on the other side in said recess 201 and at least one flexible lip 203 at least partially closing said aperture 202.

To stretch and fix the fabric 7 on each cladding section 6 as shown in FIG. 5, the peripheral edge of said fabric 7, which comprises no fastening means, is inserted, using a laying tool, into the recess 201 of said clamping section 20 through the aperture 202 by pushing the free end 203 of the flexible lip. When removing the laying tool, the fabric 7 is held by the clamp formed by an edge of the aperture 202 and the free end of the flexible lip 203.

Figure 6:
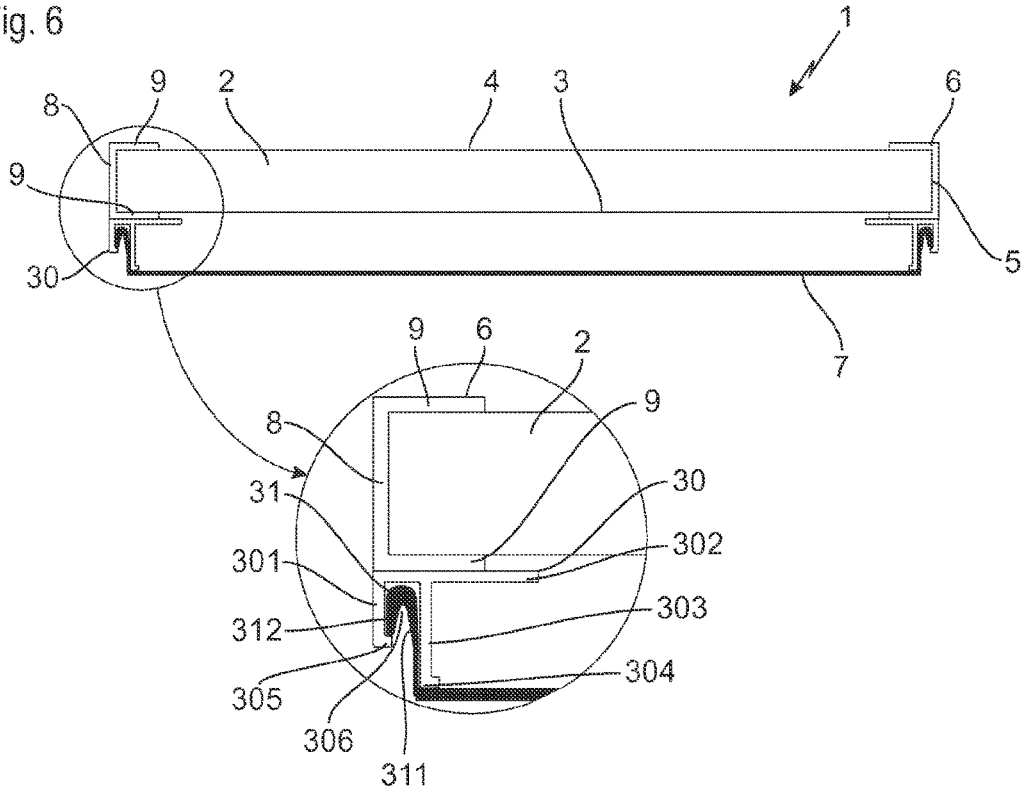
FIG. 6 is a vertical section of a removable panel with a fourth alternative embodiment of the re-cladding device according to the invention.

In a fourth alternative embodiment shown in FIG. 6, each cladding section 6 is similar to that shown in FIG. 3 and is associated with a clamping section 30 fixed, by any suitable means, to the flange 9 in contact with the outer face 3 of the removable panel 2. The clamping section 30 comprises at least one outer flange 301 which extends preferably substantially parallel to the core 8 of the cladding section 6, an inner core 302 originating from one of the ends of the outer flange 301 and extending substantially perpendicularly from said outer flange 301, and an inner flange 303 originating from the inner core 302, extending toward the outside of said cladding section 6 parallel to the outer flange 301 and the free end of which forms a narrow peripheral support 304. In addition, the outer flange 301 has a shoulder 305 extending perpendicularly from the free end thereof toward the inner flange 303.

The outer flange 301, a portion of the inner core 302, the inner flange 303 and the shoulder 305 define an open recess 306 on the side opposite said inner core 302.

For this fourth alternative embodiment, the fabric 7 is provided with fastening means 31 fixed to the periphery thereof and enabling to fix said stretched fabric 7 to the clamping section 30. In order not to damage the fabric 7 and the peripheral fastening means 31 thereof, the inner vertical flange 303 and the shoulder 305 advantageously have a rounded free end.

Similarly, to facilitate the positioning of the fabric 7, the shoulder 305 may include a cut face (not shown) to facilitate the insertion of the means for fastening 31 said fabric 7 in said recess 306.

Said peripheral fastening means 31 is preferably of the harpoon type having the shape of a hook, able to cooperate with the clamping section 3 by engaging into the recess 306 thereof. Said fastening means 31 thus comprises a inner leg 311 by which it is fixed to the fabric 7 and an outer leg 312 having the shape of a seam with a rounded end folded toward said fabric 7. Said inner and outer legs 311, 312 are advantageously solid.

Once inserted into the recess 306 of the wall rail, said fastening means 31 is then supported by the shoulder 305 with the free end of its outer leg 312 and makes it possible to keep the fabric 7 stretched only where supported by said peripheral support 304.

The two alternative embodiments above also make it possible to stretch two fabrics 7 on the removable panel 2, with one of the fabrics 7 being stretched on the cladding sections 6 and the other one being stretched by the clamping sections 20. Aesthetic effects can thus be created using for example an opaque fabric 7 stretched on the cladding sections 6 and an at least partially translucent or transparent and/or at least partly perforated fabric 7 stretched by the clamping sections 20.

Figure 7:
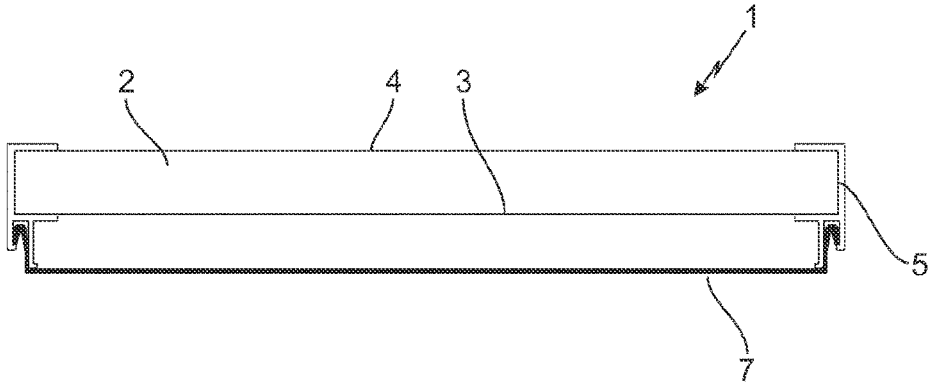
FIG. 7 is a vertical section of a removable panel with a fifth alternative embodiment of the re-cladding device according to the invention.

According to a fifth alternative embodiment shown in FIG. 7, the cladding section, which is similar to the cladding section 6 shown in FIG. 3, and the clamping section, which is similar, for example, to the clamping section 30 shown in FIG. 6, are solid, to form a single piece.

Figure 8:
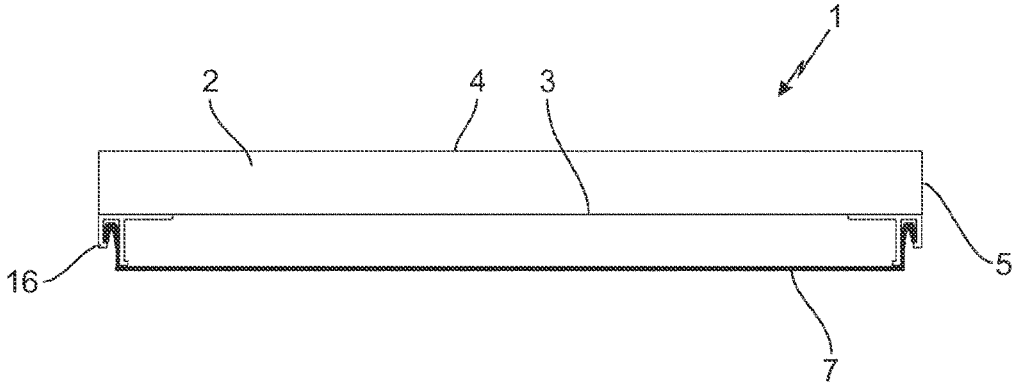
FIG. 8 is a vertical section of a removable panel with a sixth alternative embodiment of the re-cladding device according to the invention.

Finally, according to a sixth alternative embodiment shown in FIG. 8, the device 1 for re-cladding a removable panel 2 according to the invention comprises at least two cladding sections 16 which have no vertical section in the overall shape of a C but which are clamping sections similar to, for example, the clamping section 30 illustrated in FIG. 6, with said cladding sections 16 then being advantageously fixed facing one another along two respective opposing regions of said peripheral edge 5 and on the outer face 3 of the removable panel 2.

As described above, the invention will find an application to any type of degraded false walls in industrial buildings but also in private houses, desired to be easily re-clad while keeping the existing removable panels.

Furthermore, the invention is not limited to the cladding of removable panels 2 having a parallelepiped shape, but can also cover already cut or modified removable panels having various shapes or even access doors.

Eventually, the present invention is clearly not limited to the sole embodiment of this installation and, on the contrary, it encompasses all the alternative embodiments and applications thereof which follow the same principle.

The invention claimed is:

1. A re-cladding device for re-cladding only one removable false-wall one-piece panel, said only one removable false-wall one-piece panel consisting of: a lower face, an upper face situated on an opposite side to the lower face and a peripheral edge joining the lower face and the upper face, said re-cladding device comprising:

at least two cladding sections respectively assembled with a clamping section, said at least two cladding sections being fixed facing one another along two respective opposing regions of said peripheral edge, each cladding section of the at least two cladding sections comprising a core and two flanges respectively in contact with the lower and upper faces of the only one removable false-wall one-piece panel, a stretchable fabric kept stretched along the lower face of the only one removable false-wall one-piece panel by said at least two cladding sections; and each said clamping section being attached to a flange of the two flanges of an associated cladding section of said at least two cladding sections in contact with the lower face of the only one removable false-wall one-piece panel, each said clamping section comprising a recess having an aperture opening under the lower face of the only one removable false-wall one-piece panel and arranged to allow fastening of the stretchable fabric, said recess being delimited by an outer flange extending parallel to the core of each cladding section of said at least two cladding sections and an internal flange, wherein said outer flange is aligned with said core and said peripheral edge and wherein each said clamping section is located directly beneath an associated cladding section of said at least two cladding sections.

2. The re-cladding device according to claim 1, wherein the at least two cladding sections form a closed frame fixed along an entirety of said peripheral edge.

3. The re-cladding device according to claim 1, wherein each cladding section of the at least two cladding sections is fixed to the only one removable false-wall one-piece panel by at least one of force fitting, gluing, nailing and screwing.

4. The re-cladding device according to claim 1, wherein each cladding section of the at least two cladding sections, a cross section of which is in the overall shape of a C, comprises a core and two flanges extending substantially perpendicularly from ends of said core.

5. The re-cladding device according to claim 1, wherein the stretchable fabric is in contact with the lower face of the only one removable false-wall one-piece panel and the peripheral edge thereof is held clamped between said at least two cladding sections and said only one removable false-wall one-piece panel.

6. The re-cladding device according to claim 1, wherein each cladding section of the at least two cladding sections is fixed to the only one removable false-wall one-piece panel such that the core and the two flanges are respectively in contact with the peripheral edge and the lower and upper faces of the only one removable false-wall one-piece panel.

7. The re-cladding device according to claim 6, wherein the stretchable fabric is not in contact with the lower face of the only one removable false-wall one-piece panel and is fixed and stretched on the at least two cladding sections while being supported at least by the two flanges thereof in contact with the lower face of the only one removable false-wall one-piece panel.

8. The re-cladding device according to claim 6, wherein the stretchable fabric is fixed to the at least two cladding sections with at least one of glue, nails and screws.

9. The re-cladding device according to claim 6, wherein each cladding section of said at least two cladding sections comprises at least one housing adapted to cooperate with a fixing clamp, with the stretchable fabric being then fixed to each of said at least two cladding sections while being held clamped in said at least one housing by the fixing clamp.

10. The re-cladding device according to claim 1, wherein each cladding section of the at least two cladding sections is a clamping section fixed to the only one removable false-wall one-piece panel.

11. The re-cladding device according to claim 1, wherein each cladding section of the at least two cladding sections is associated with a clamping section fixed on the two flanges in contact with the lower face of the only one removable false-wall one-piece panel.

12. The re-cladding device according to claim 10, wherein each clamping section comprises at least one longitudinal inner recess in an overall shape of a U extending substantially parallel to the core of each said cladding section of the at least two cladding sections, with an aperture opening on one side to an outside, and on another side in said recess and at least one flexible lip at least partially closing said aperture.

13. The re-cladding device according to claim 10, wherein each clamping section comprises at least one outer flange extending substantially parallel to the core of each said cladding section of said at least two cladding sections, with an inner core originating from one end of the outer flange and extending substantially perpendicularly from said outer flange, and an inner flange originating from the inner core extending toward an outside of each of said at least two cladding sections parallel to the outer flange and a free end of which forms a peripheral support, with the outer flange having a shoulder extending perpendicularly from the free end thereof towards the inner flange, the outer flange, a portion of the inner core, the inner flange and the shoulder defining an open recess.

14. The re-cladding device according to claim 13, wherein the stretchable fabric is provided with fastening means fixed at a periphery thereof and having the shape of a hook.

15. The re-cladding device according to claim 11, wherein the at least two cladding sections and the associated clamping section are solid.

* * * * *